US006249232B1

(12) United States Patent
Tamura et al.

(10) Patent No.: US 6,249,232 B1
(45) Date of Patent: Jun. 19, 2001

(54) INTER-VEHICULAR COMMUNICATION METHOD

(75) Inventors: Kazuya Tamura; Hiroshi Mashimo, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/078,549

(22) Filed: May 14, 1998

(30) Foreign Application Priority Data

May 16, 1997 (JP) ..... 9/126852

(51) Int. Cl.[7] ..... G08G 1/00
(52) U.S. Cl. ..... 340/902; 340/905; 180/167
(58) Field of Search ..... 340/903, 988, 340/902, 933, 991; 180/169, 167

(56) References Cited

U.S. PATENT DOCUMENTS 3,825,897 * 7/1974 Lawton ..... 340/536
5,680,122 * 10/1997 Mio ..... 340/902
5,682,139 * 10/1997 Pradeep et al. ..... 340/991
5,720,455 * 2/1998 Kull et al. ..... 340/902

* cited by examiner

*Primary Examiner*—Brent A. Swarthout
(74) *Attorney, Agent, or Firm*—Arent Fox Kintner Plotkin & Kahn, PLLC

(57) ABSTRACT

To provide an inter-vehicular communication method which enables a plurality of vehicles to efficiently exchange information. A plurality of vehicles are assigned identification numbers (IDs) and perform transmission of information in order, on the basis of their identification numbers. A time which is allocated so that each of the vehicles can perform a transmission, is constant (one cycle=4 ms), and a time at which the vehicle of ID=1 starts its first transmission is set as a reference time. The vehicles of ID=2, ID=3 and ID=1 . . . sequentially perform their transmissions 4 ms, 8 ms and 12 ms . . . after the reference time. Thus, it is possible to avoid a problem that the plurality of vehicles perform their transmissions at the same time, and it is also possible to minimize the waste of time and to exchange information in a short time.

5 Claims, 3 Drawing Sheets

INTER-VEHICULAR COMMUNICATION METHOD

BACKGROUND OF THE INVENTION

1. Field of the Invention

The present invention relates to an inter-vehicular or vehicle-to-vehicle communication method which allows a plurality of vehicles to exchange information, such as their vehicle positions and their vehicle speeds, with each other.

2. Description of the Prior Art

Conventionally, inter-vehicular communication can be performed by using light or radio waves between a preceding traveling vehicle and a succeeding traveling vehicle and allowing the vehicles to exchange on a one-to-one basis the position information and the speed information which are required to keep constant a vehicle-to-vehicle distance.

However, the above-described prior art is a one-to-one communication between two vehicles and has a problem that a plurality of vehicles cannot exchange information when they are traveling in a vehicle group.

SUMMARY OF THE INVENTION

The present invention has been made in view of the above-described problem, and its object is to provide an inter-vehicular communication method which enables a plurality of vehicles to efficiently exchange information.

To achieve the above object, the invention provides an inter-vehicular communication method which assigns identification numbers, in order, to a plurality of vehicles and allows each of the vehicles to transmit information including the identification number of the vehicle itself to other vehicles in order starting from the smallest identification number. The method is characterized in that a vehicle which performs its transmission after a first transmission starts the transmission when a time elapses from the start of the first transmission or the end of the first transmission, which time is determined according to the identification number of the vehicle on the basis of the first transmission starting time or the transmission ending time.

According to the above-described feature, since each of the vehicles starts transmission of information in order at a time assigned according to its identification number, it is possible to prevent occurrence of accidents; for example, when the plurality of vehicles perform transmission at the same time or none of the vehicles performs transmission, whereby it is possible to perform accurate information exchange in a minimum time.

In addition to the above feature, the vehicle which performs its transmission after the first transmission, ends the transmission at a time limit from the first transmission starting time or the first transmission ending time. The time limit is determined according to the identification number of the vehicle on the basis of the first transmission starting time or the first transmission ending time.

According to the above-described feature, even if the transmission of a particular vehicle is delayed for some reason, the transmission is forced to end at the time limit so that the delay is prevented from affecting the transmission of the next vehicle.

In addition to the above feature, the identification number assigning means are installed along a road for the vehicles, and the vehicles which pass the identification number assigning means are assigned to the identification numbers in order, respectively. It is thus possible to automatically and accurately assign the identification numbers.

The information transmitted from one vehicle to another includes, in addition to the identification number of the vehicle itself, at least one of the vehicle position, vehicle speed, acceleration, deceleration, angle of longitudinal vehicle inclination, an operational amount of a brake system, an operational amount of a steering gear, and a gear selected by a transmission. It is thus possible to exchange these various kinds of information through the inter-vehicular communication.

DETAILED DESCRIPTION OF THE PREFERRED EMBODIMENT

Figure 1:
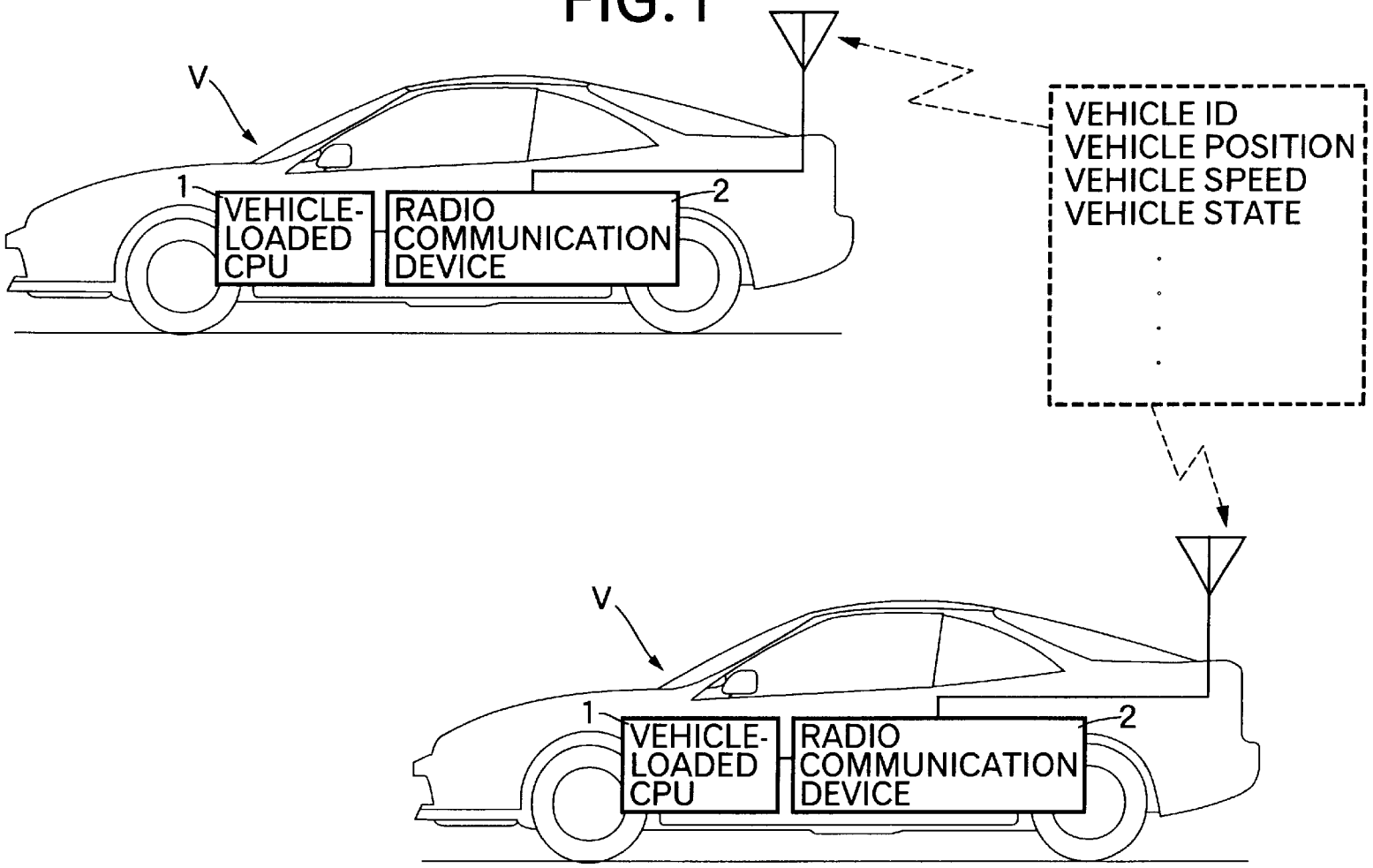
FIG. 1 shows a vehicle provided with an inter-vehicular communication device according to an embodiment of the present invention.

As shown in FIG. 1, a vehicle V which performs inter-vehicular communication is provided with a communication device 2 controlled by an electronic control unit 1 provided in the vehicle V. The communication device 2 includes a transmitter and a receiver, and can transmit information to another vehicle and receive information from another vehicle, through radio waves. The information communicated includes an identification number (ID) of a vehicle, the vehicle position, vehicle speed, and other vehicle states (for example, acceleration, deceleration, angle of longitudinal vehicle inclination, operational amount of a brake system, operational amount of a steering gear, and the gear selected by the transmission). Although the identification number is indispensable, the other items of information can be arbitrarily determined as required. A spread spectrum communication which has a high resistance to interference may be used as the communication system.

The identification number is automatically assigned in accordance with the order in which the vehicle V passes a gate of an automatic toll collection system (a system which allows the vehicle V to pay a toll without stopping at a tollgate) so that the vehicle V is permitted to travel on an automatic traveling road. Incidentally, if the number of vehicles which form a vehicle group is known from the beginning, the identification numbers can also be manually assigned in advance.

Figure 2:
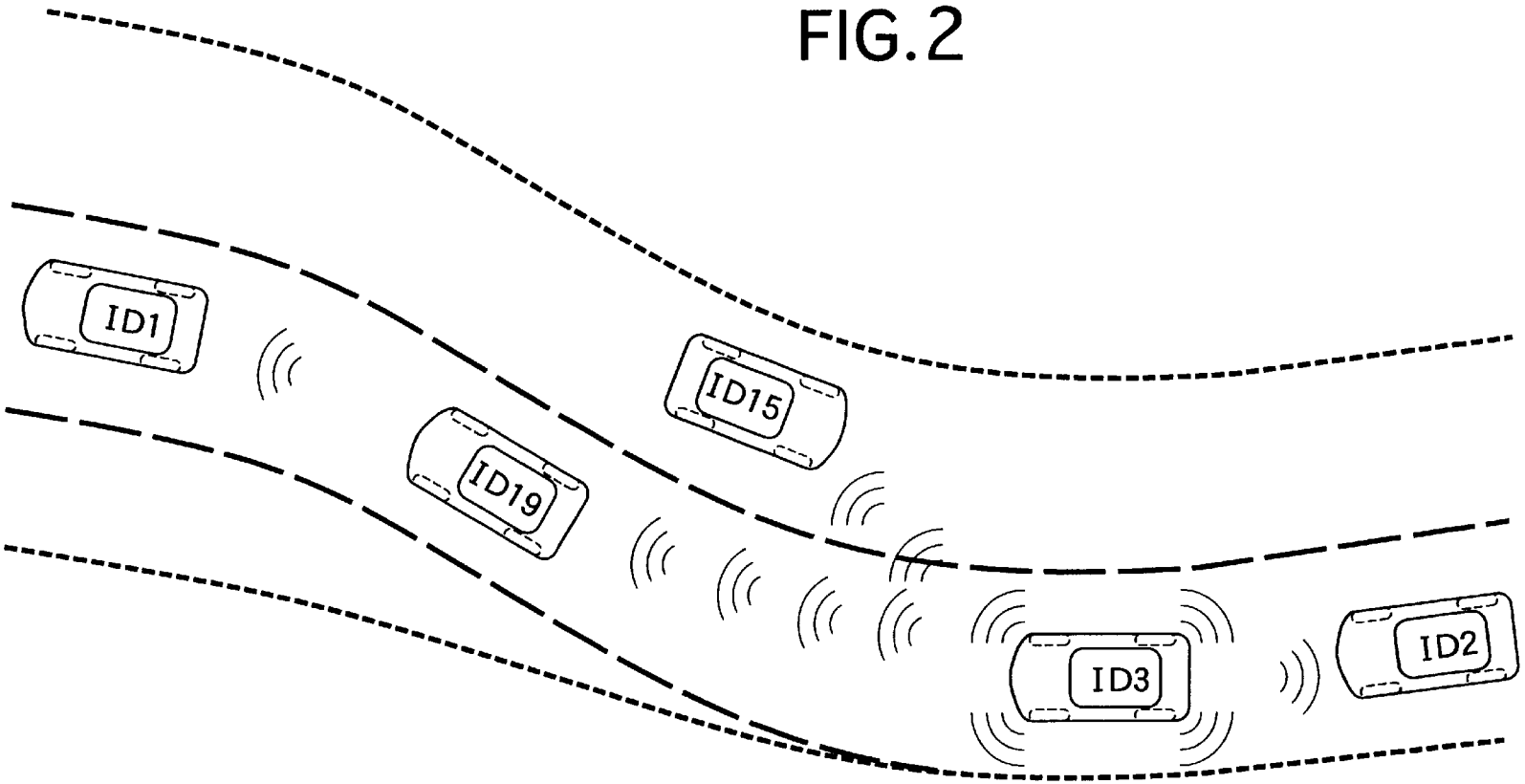
FIG. 2 shows a state in which inter-vehicular communication is being performed.

Thus, as shown in FIG. 2, while a plurality of vehicles which form a vehicle group are automatically traveling, each of the vehicles transmits information about itself, in order, and other vehicles receive the information so that the plurality of vehicles can perform communication between themselves.

Figure 3:
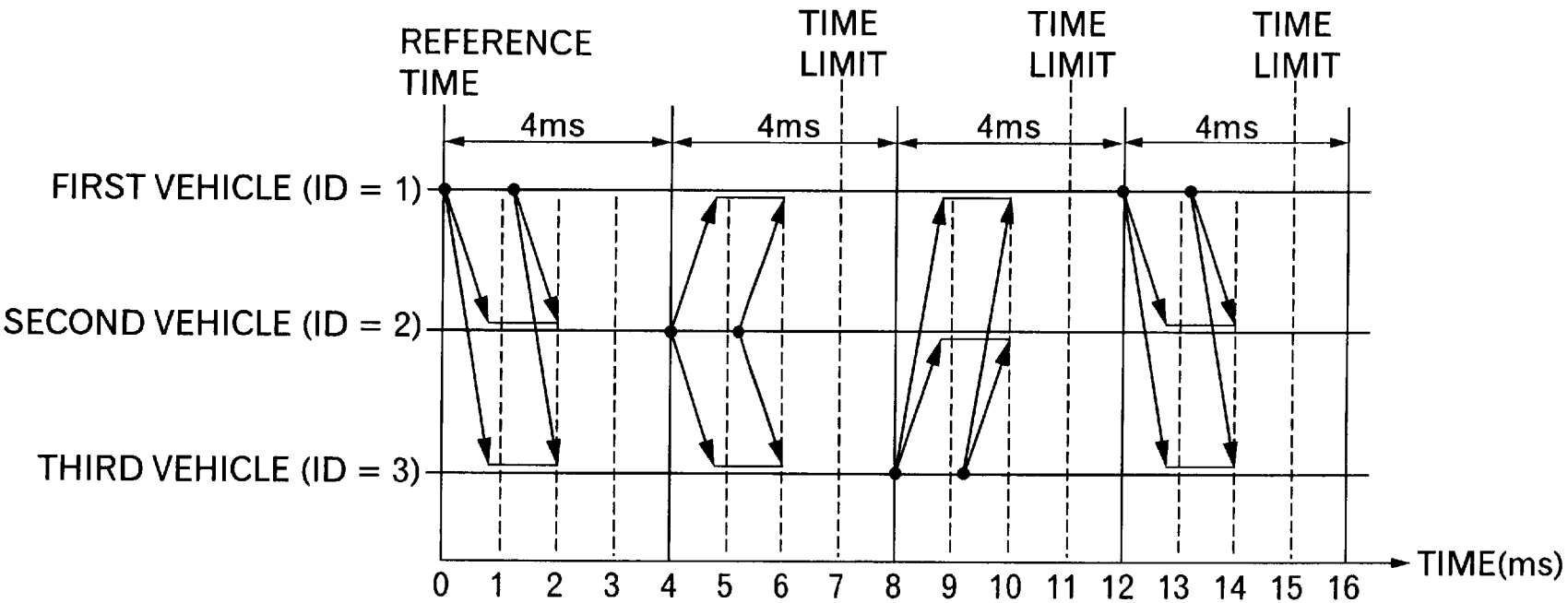
FIG. 3 is a time chart showing the communication timing of the inter-vehicular communication according to an embodiment of the present invention.

The timing for each vehicle to start and end its transmission will now be described with reference to the timing chart of FIG. 3. Although a case where communication is performed between three vehicles whose IDs are 1, 2 and 3 is described below by way of example, substantially the same contents can be obtained even in the case where communication is performed between four or more vehicles as shown in FIG. 2.

In the inter-vehicular communication, transmission is performed in the ascending order of the identification numbers starting from the vehicle having the smallest identification number (ID=1) so that a plurality of vehicles are prevented from transmitting information at the same time, and when the last vehicle (ID=3) ends its communication, transmission is again performed in order, from the first vehicle (ID=1). This process is repeated any number of times.

Timing for each of the vehicles to start and end its transmission is determined on the basis of a reference clock of the vehicle of ID=1 which is the smallest identification number. In the embodiment, the time of one cycle allocated to each of the vehicles is 4 ms, and actual transmission is performed during the first half of 2 ms, but the second half of 2 ms is a blank time during which no transmission is performed. However, the first half of 2 ms during which transmission is performed slightly varies according to the amount of information, and if the first half becomes 2.1 ms, for example, the blank time becomes 1.9 ms because the time (4 ms) of one cycle is constant.

Therefore, if a time at which the vehicle of ID=1 starts its first transmission, is set as a reference time, a time at which the vehicle of ID=2 starts its transmission is 4 ms later than the reference time, a time at which the vehicle of ID=3 starts its transmission is 8 ms later than the reference time, and the time at which the vehicle of ID=1 starts its second transmission is 12 ms later than the reference time. In this manner, the time at which the vehicle of ID=1 starts its first transmission is set as the reference time and each of the vehicles of ID=2 and later starts its transmission when the time determined according to its identification number passes, whereby it is possible to avoid the problem when a plurality of vehicles are transmitting at the same time, and it is also possible to minimize the waste of time and thereby exchange information in a short time.

When the vehicle of ID=1 starts its transmission and the reference time is determined, the times at which the other vehicles start their transmission are definitely determined according to the reference time. For example, if the transmission of the vehicle of ID=2 is delayed for some reason, there is a possibility that the transmission of the vehicle of ID=2 may overlap the following transmission of the vehicle of ID=3. To avoid such a possibility, a time limit is set at the time of the end of each of the transmissions, and if transmission has not yet come to an end at the time of the time limit, the transmission is forceably brought to an end.

Since the time limit is determined on the basis of the identification number of each of the vehicle with reference to the reference time, the time limit of the first transmission of the vehicle of ID=2 is set to a time 7 ms later than the reference time, the time limit of the first transmission of the vehicle of ID=3 is set to a time 11 ms later than the reference time, and the time limit of the second transmission of the vehicle of ID=1 is set to a time 15 ms later than the reference time. Specifically, if a transmission has not yet come to an end at a time when 1 ms passes after an original time to bring the transmission to an end, the transmission is forceably brought to an end at that time, whereby it is possible to avoid interference with transmissions of the following vehicles.

Although in the above embodiment the time at which the vehicle of ID=1 starts its first transmission is set to the reference time, and the transmission starting time and the time limits of the other vehicles are determined on the basis of the reference time, a time at which the vehicle of ID=1 ends its first transmission may also be set to the reference time, and this setting has the following merits. Specifically, in a case where the vehicle of ID=1 starts its first transmission with the other vehicles being not yet ready for reception, none of the other vehicles can identify a reference time when the vehicle of ID=1 has started the transmission. As a result, the other vehicles are not able to calculate their transmission starting time and their time limits, until the vehicle of ID=1 starts its second transmission.

However, if the time at which the vehicle of ID=1 ends the transmission in the first transmission is set to the reference time, it is guaranteed that the other vehicles are ready for reception, whereby it is possible to perform communication without wasting time.

As described above, a vehicle which performs its transmission in a second transmission or later starts the transmission when a time elapses from a transmission starting time or a transmission ending time for the vehicle which performs the first transmission, which time is determined according to the identification number of the vehicle on the basis of the transmission starting time or the transmission ending time. Accordingly, it is possible to prevent occurrence of accidents; for example, when a plurality of vehicles perform transmission at the same time or when none of the vehicles performs transmission, and it is possible to perform accurate information exchange in a minimum time.

The vehicle which performs its transmission in the second transmission or later, forceably brings the transmission to an end at a time limit from the transmission starting time or the transmission ending time of the vehicle which performs the first transmission. The time limit is determined according to the identification number of the vehicle on the basis of the first transmission starting time or the first transmission ending time. Accordingly, even if the transmission of a particular vehicle is delayed for some reasons, the transmission is forceably brought to an end at the time limit, so that a delay is prevented from affecting the transmission of the next vehicle.

Identification number assigning means are installed along a road for the vehicles, and the vehicles which pass the identification number assigning means are assigned the identification numbers in order, whereby it is possible to automatically and accurately assign the identification numbers.

The information transmitted from the vehicle includes, in addition to the identification number of the vehicle itself, at least one of the vehicle position, vehicle speed, acceleration, deceleration, angle of longitudinal vehicle inclination, the operational amount of the brake system, the operational amount of a steering gear, and the gear selected by a transmission. Accordingly, it is possible to exchange various kinds of information through inter-vehicular communication.

Although the embodiment of the present invention has been described above in detail, various design modifications of the present invention may be made without departing from the gist of the present invention.

What is claimed is:

1. A method of inter-vehicular communication between a plurality of vehicles comprising the steps of:

(a) assigning, in order, identification numbers to each of the vehicles in the plurality of vehicles;

(b) transmitting from each vehicle to at least one other vehicle, in order, starting from a smallest identification number, information including the identification number of the vehicle;

(c) wherein a first transmission from the vehicle having the smallest identification number functions as a reference time and wherein the first transmissions from the other vehicles and succeeding transmissions from all vehicles start after a predetermined time delay from the reference time; and (d) wherein the vehicle identification numbers are assigned as the vehicles pass an identification number assigning means positioned along a road.

2. A method of inter-vehicular communication according to claim 1, wherein the reference time is the start of the transmission of the first transmission of the vehicle with the smallest identification number.

3. A method of inter-vehicular communication according to claim 1, wherein the reference time is the end of transmission of the first transmission of the vehicle with the smallest identification number.

4. A method of inter-vehicular communication according to claim 1, wherein a vehicle which performs its transmission after the first transmission forceably ends the transmission after a predetermined time limit from the reference time, the time limit being determined based upon the identification number of the vehicle.

5. A method of inter-vehicular communication according to claim 1, wherein the information transmitted from each vehicle includes, in addition to the identification number of the vehicle itself, at least one of the vehicle position, vehicle speed, acceleration, deceleration, angle of longitudinal vehicle inclination, an operational amount of the vehicle brake system, an operational amount of a steering gear, and a gear selected in a transmission.

* * * * *